US008622051B2

(12) United States Patent
Summers et al.

(10) Patent No.: US 8,622,051 B2
(45) Date of Patent: Jan. 7, 2014

(54) BACK-TENSION ARCHERY RELEASE

(75) Inventors: Gregory E. Summers, Amherst, VA (US); Marc T. Renz, Madison Heights, VA (US)

(73) Assignee: Gregory E. Summers, Amherst, VA (US)

( * ) Notice: Subject to any disclaimer, the term of this patent is extended or adjusted under 35 U.S.C. 154(b) by 216 days.

(21) Appl. No.: 13/106,434

(22) Filed: May 12, 2011

(65) Prior Publication Data

US 2012/0285431 A1 Nov. 15, 2012

(51) Int. Cl.
*F41B 5/18* (2006.01)

(52) U.S. Cl.
USPC ..... 124/35.2

(58) Field of Classification Search
USPC ..... 124/35.2
See application file for complete search history.

(56) References Cited

U.S. PATENT DOCUMENTS

| | | | | |
|---|---|---|---|---|
| 5,694,915 | A | 12/1997 | Summers | |
| 6,205,991 | B1 * | 3/2001 | Summers et al. | 124/35.2 |
| 2008/0149084 | A1 * | 6/2008 | Whalen et al. | 124/35.2 |

* cited by examiner

*Primary Examiner* — John Ricci
(74) *Attorney, Agent, or Firm* — Leading-Edge Law Group, PLC

(57) ABSTRACT

A back-tension archery release includes a handle with an adjustable sear housing and an adjustable finger. The handle has a longitudinal axis. The sear housing is adjustable about an axis normal to the longitudinal axis to eliminate twist or torque in a bowstring loop connected with the release. The finger is adjustable about the longitudinal axis to increase or decrease the speed of the release and provide an improved ergonomic feel to the user. In addition, the finger is removable from the handle so that differently configured fingers may be substituted by the user.

20 Claims, 3 Drawing Sheets

BACK-TENSION ARCHERY RELEASE

BACKGROUND OF THE INVENTION

The present invention relates to an archery release, and more particularly to a back-tension type archery release for a bowstring.

Release devices are used in archery to assist the archer in pulling a bowstring to a fully drawn position and then releasing the bowstring to fire an arrow. Some release devices use grippers for engaging the bowstring or a hock mounted on the bowstring. Other release devices use a rope looped about the bowstring. In the looped rope release devices, the rope is often twisted or torqued as the archer draws the bowstring to a fully drawn position due to cocking or turning of the archer's wrist. The twist applied to the release rope results in reduced arrow speed and accuracy. The present invention relates to a release device which eliminates torque in the looped rope at full draw.

BRIEF DESCRIPTION OF THE PRIOR ART

Back-tension release devices which reduce torque are well-known in the prior art as evidenced by U.S. Pat. No. 5,694,915. This patent discloses a back-tension rope release in which a catch for a rope loop is connected with a fork which in turn is connected with a handle. The orientation of the fork relative to the handle is adjustable in order to remove torque or twist from a rope loop. The catch is also adjustable relative to the fork in order to adjust the back-tension on the rope loop. Set screws are used to hold the fork and the catch in the desired positions.

While to prior devices normally operate satisfactorily, they are somewhat cumbersome to operate and often require re-adjustment because the set screws loosen during repeated firing of the release.

SUMMARY OF THE INVENTION

The present invention was developed in order to overcome these and other drawbacks of prior archery releases by providing a back-tension archery release with improved mechanisms for eliminating torque in a bowstring loop and for adjusting the speed of the release. The release includes a handle having a longitudinal axis and a sear assembly connected with the handle for rotation about an axis normal to the handle axis. By adjusting the position of the sear assembly relative to the handle, twist or torque in the bowstring loop resulting from full draw on the bowstring by an archer is eliminated.

In order to fix the sear assembly in the adjusted position relative to the handle, a locking mechanism is provided. The housing contains a central recess in a rear surface thereof which receives a post on the handle, so that the housing is rotatable relative to the handle. The post contains a threaded opening for receiving a screw which passes through the opening in the handle to lock the sear housing in a selected position. In addition, the locking mechanism includes a detent provided on the handle which engages one of a plurality of spaced openings in the rear surface of the sear housing when the sear assembly is adjusted to a selected position.

A sear is removably connected with the sear housing and a sear cage is rotatably connected with the sear housing about an axis parallel to the handle axis. The sear contains a groove in an upper surface at one end for engaging the sear cage. The groove cooperates with the sear cage to generate an audible sound when the release is actuated. Where the archer prefers that no sound be generated upon actuation of the release, the sear may be removed and re-oriented with an end of the sear which does not contain a groove engaging the sear cage.

The archery release further includes a finger removably connected with the handle and extending radially outwardly therefrom. The finger is adjustable about the handle axis to increase or decrease the speed of the release. More particularly, the handle contains an elongated slot in an outer surface and the finger contains a stem arranged within the slot for adjusting the finger relative to the handle axis. A pinch plate is provided between the finger step and the handle to fix the finger in a selected position. The handle and pinch plate contain at least one aligned opening and a screw engages the aligned openings to lock the finger in the selected position.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
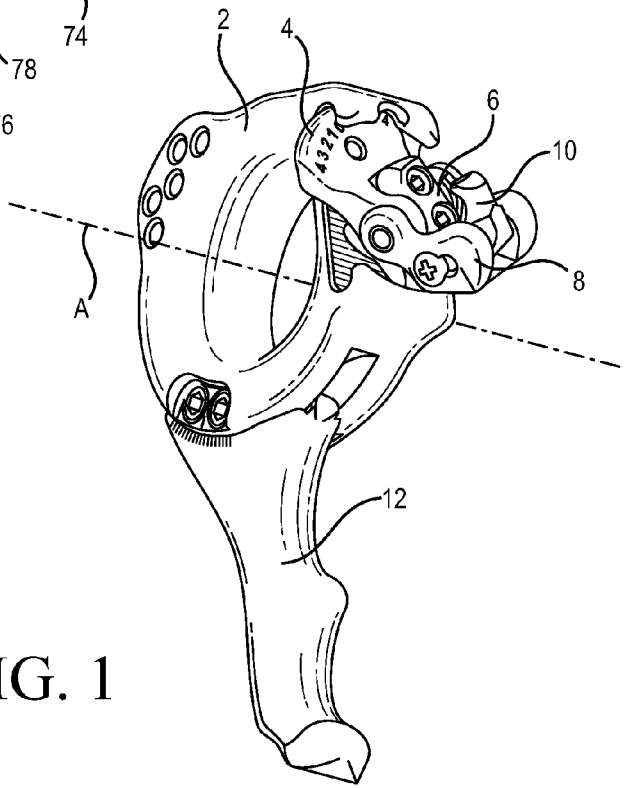
FIG. 1 is a front perspective view of the back-tension archery release according to the invention.
Figure 2:
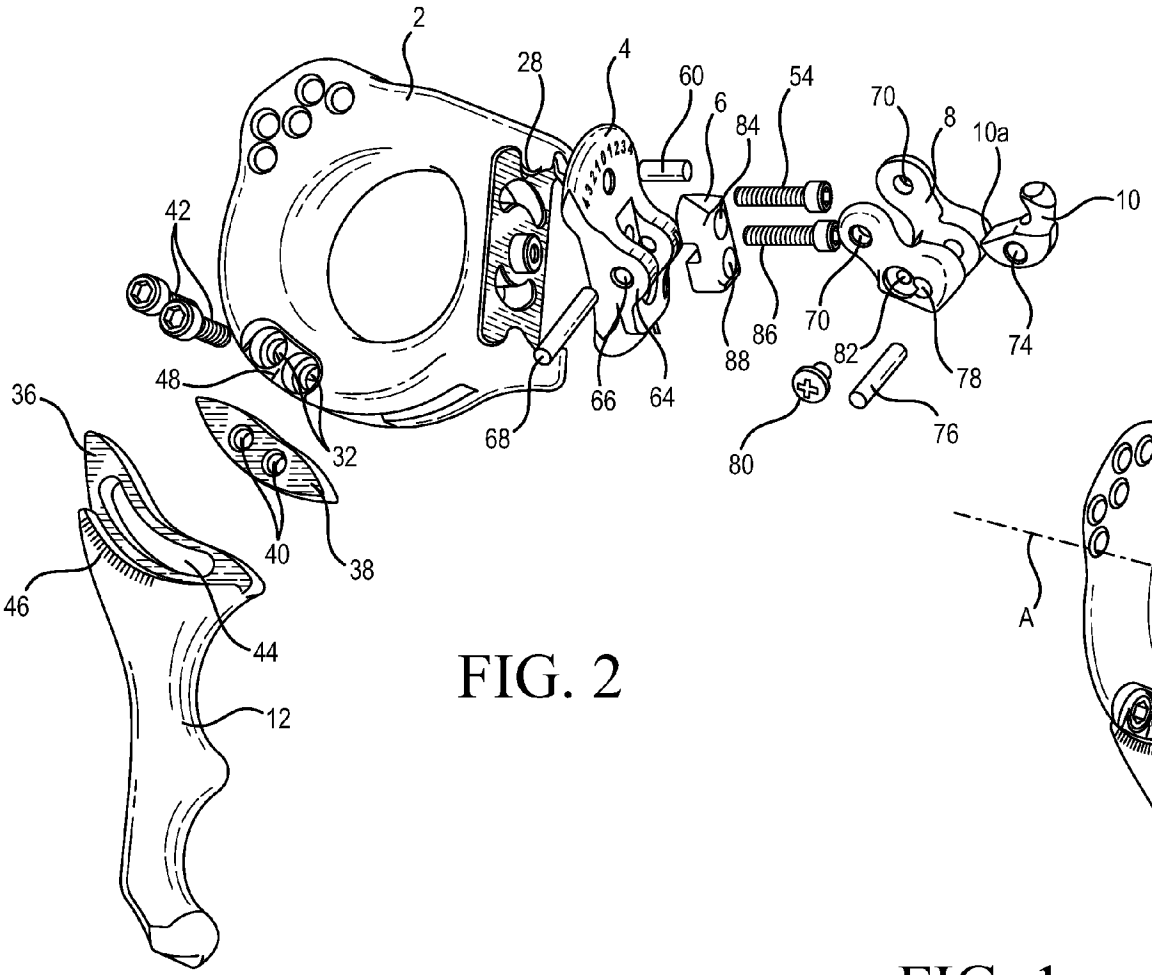
FIG. 2 is an exploded view of the archery release of FIG. 1.

As shown in FIGS. 1 and 2, the back-tension archery release according to the invention comprises a number of components which are shown in greater detail in FIGS. 3-13. More particularly, the release includes a handle 2 with which a sear housing 4 is rotatably connected. A sear 6 and sear cage 8 are connected with the sear housing and a hook 10 is connected with the sear housing. A finger 12 is connected with the handle and extends radially therefrom. In use, hook engages the loop of a bowstring (not shown) and the release is operable to release the bowstring from the hook to fire an arrow.

Figure 4:
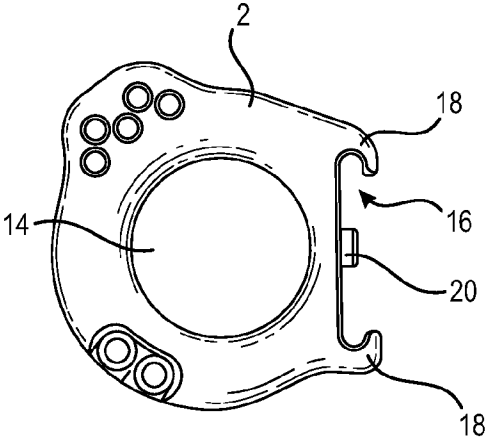
FIGS. 4 and 5 are front and side plan views of the handle of FIG. 4.
Figure 7:
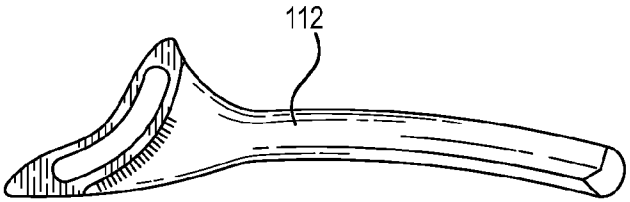
FIG. 7 is a front plan view of an alternate finger for use with the archery release of FIG. 1.
Figure 5:
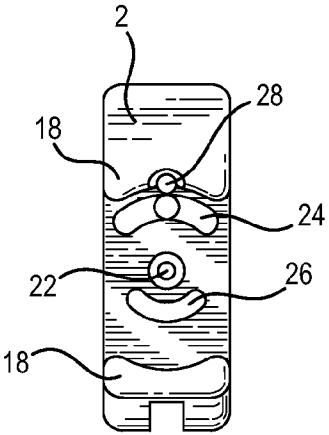
Figure 3:
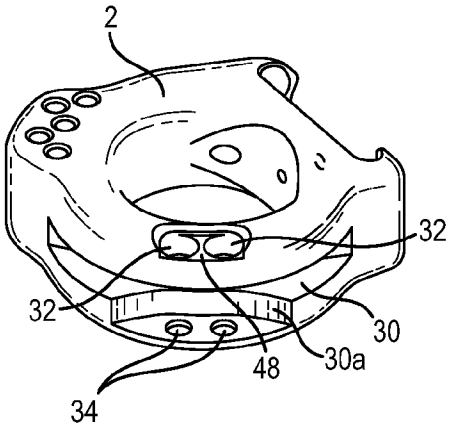
FIG. 3 is a perspective view of the handle of the archery release of FIG. 1.

The handle is shown in greater detail in FIGS. 3-5. It contains a central opening 14 for receiving the index finger of an archer. The longitudinal axis A of the handle passes through the center of the opening as shown in FIG. 1. At one side of the handle, the exterior surface contains a recess 16 defined by overhanging lip portions 18 at the upper and lower edges of the recess. A post 20 extends from the handle in the central portion of the recess. The post contains a threaded opening 22. Above the post is an upper arcuate recess 24 and below the post is a lower arcuate recess 26. A detent 28 extends outwardly from a central portion of the upper lip portion as shown in FIG. 5. As will be developed below, the handle recess 16 is adapted to receive the sear housing 4.

Figure 6:
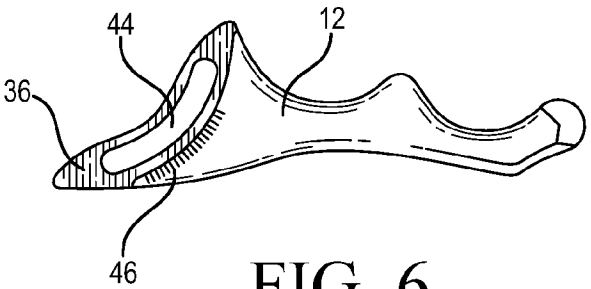
FIG. 6 is a front plan view of the finger of the archery release of FIG. 1.

The outer surface of the handle further contains a slot 30 in a lower portion of the handle relative to the recess 16. The slot is shown more particularly in FIG. 3. Communicating with the slot are aligned openings 32 and 34. The openings 34 are preferably clearance openings. The slot accommodates the finger 12. More particularly, the finger, which is shown in FIG. 6, contains a stem 36 at one end which is contoured to fit within the slot 30. A pinch plate 38 fits within a slot of the finger stem and within a matching contoured portion 30*a* of the slot 30 to adjustably connect the finger with the handle. The pinch plate contains a pair of threaded openings 40. A pair of screws 42 are provided to secure the finger stem 36 and pinch plate 38 within the slot. The screws pass through the openings 32 in the handle and engage the threaded openings 40 in the pin plate via a slot 44 in the finger stem 36. When the screws are loosened, the finger stem can be shifted or moved within the slot about the axis of the handle to displace the finger toward or away from the portion of the handle containing the recess. When the screws are tightened, the pinch plate within the finger stem slot draws the stem against the handle to lock the finger in position. Positioning the finger toward the recess will increase the speed of the release. Positioning the finger away from the recess will decrease the speed of the release. The finger can also be positioned in accordance with the preferred ergonomic position of the user. The finger contains markings 46 such as engraved marks to provide an indication of the position of the finger to the user for proper adjustment of the finger relative to an indicator 48 on the handle so that the user can consistently adjust the finger to a desired position.

In a preferred embodiment, the finger 12 is contoured to accommodate the other fingers of the archer's hand. In the embodiment shown in FIGS. 1, 2, and 6, the finger 12 accommodates two additional fingers. In the embodiment shown in FIG. 7, a non-contoured finger 112 is provided to accommodate any number of fingers. Other contoured finger shapes may be provided if desired. Because the finger is removably connected with the handle, it is a simple matter to replace a finger of one contour with a finger of a different contour. Whatever finger contour is selected, the finger is still adjustable relative to the handle to adjust the speed of the release.

Figure 8:
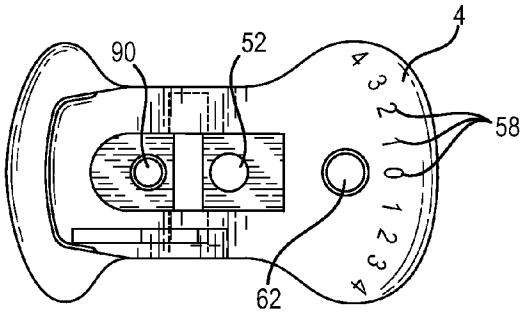
FIGS. 8, 9, and 10 are top, bottom and left side views, respectively, of the sear housing of the archery release of FIG. 1.
Figure 9:
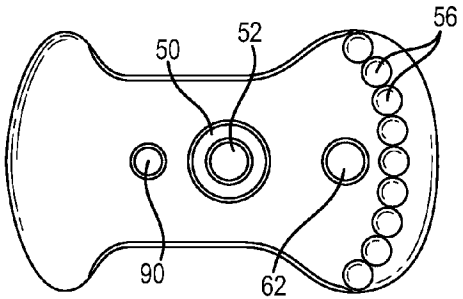
Figure 10:
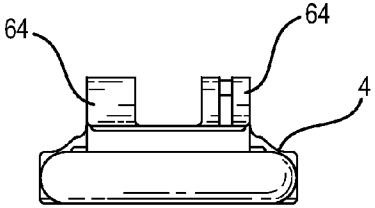

Turning now to FIGS. 8-10, the sear housing 4 will be described. The housing is elongated and contains a recess 50 in the central region of the bottom surface thereof. The recess contains a through-opening 52 and is adapted to receive the post 20 of the handle so that the housing can rotate relative to the handle about an axis normal to the handle axis A. A screw 54 connects the housing with the handle by passing through the through-opening 52 into the threaded opening 22. The rear surface of the housing further contains a plurality of openings 56 arranged in an arc between an edge of the housing and the central recess 50. The openings receive the detent 28 on the handle to hold the housing in a selected position relative to the handle. Thus, when the screw 54 is loosened, the housing may be rotated in either direction relative to the handle. When the housing in the desired position, which is selected by the user to eliminate torque or twist in a bowstring loop, the detent 28 engages one of the openings 56 opposite the detent and the screw 54 is tightened to lock the housing in place. The openings are preferably spaced at ten degree increments relative to a vertical orientation of the release as shown in FIG. 1, thereby affording adjustment of between 0° and 40° on either side of vertical. This allows the housing to be rotated in either direction for adjustment for both left and right-handed users. Indicia 58 are provided on the upper surface of the housing to indicate the degree of orientation of the housing relative to the handle. If desired, a guide pin 60 (FIG. 2) is provided for the housing. It passes through an opening 62 in the housing adjacent to the indicia and extends into the upper arcuate recess 24 (FIG. 5) of the handle.

The sear housing 4 include a pair of spaced flanges 64 extending from the top surface on opposite sides of the central opening 52. The flanges contain aligned openings 66. The sear cage 8 (FIG. 2) is pivotally connected with the sear housing, and specifically with the flanges of the sear housing, via a pivot pin 68 which passes through a first pair of aligned openings 70 in the cage and the aligned openings 66 in the housing flanges. The sear cage thus rotates relative to the housing about an axis parallel to the handle axis.

The hook 10 contains an opening 74 for receiving a pivot pin 76 which also passes through a second pair of aligned openings 78 in the sear cage to pivotally connect the hook with the cage. The hook thus rotates relative to the cage about an axis parallel to the longitudinal axis of the handle. A pan lead screw 80 passes through a threaded opening 82 in the sear cage 8 to retain the pivot pin within the aligned openings 78.

The sear 6 is connected with the sear housing 4 via the screw 54 which passes through an opening 84 in the sear 6 and into the threaded opening 22 of the handle. A second screw 86 passes through an opening 88 in the sear and into a threaded opening 90 in the housing to further connect the sear 6 with the housing 4. If the screw is too long, it enters the lower arcuate clearance recess 26 of the handle, thereby insuring that the housing rotates freely relative to the handle.

Figure 11:
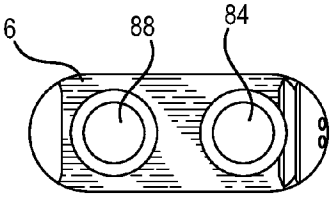
FIGS. 11, 12, and 13 are top, front and bottom plan views, respectively, of the sear of the archery release of FIG. 1.
Figure 12:
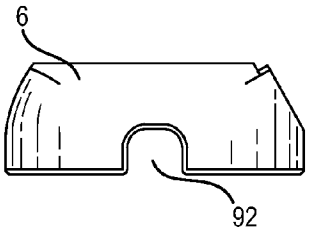
Figure 13:
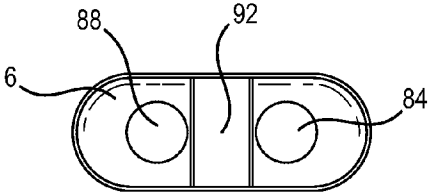

Referring now to FIGS. 11 and 12, the sear 6 is shown in greater detail. As described above, the sear contains openings 84 and 88. It also contains a groove 92 in the bottom surface thereof to straddle, locate and lock in place the pivot pin 68 for the sear cage. In addition, at one end of the sear, the upper surface contains a laterally extending groove 94. When the sear is arranged with the lateral groove toward the bottom as shown in FIG. 2, the edge 10*a* of the hook between the flat and curved surfaces engages the groove. The groove 94 cooperates with the edge of the hook to generate an audible sound when the release is actuated to release the bowstring from the hook. When the sear is arranged with the lateral groove toward the top (not shown), the hook edge engages a smooth end of the sear so that no audible sound is generated when the release is actuated.

In use, the bowstring loop is place on the hook and the user draws the bow to a full draw position. If this results in a twist of the bowstring loop, the user loosens the screw 54 and rotates the sear housing in the appropriate direction and to the appropriate degree to eliminate the twist. The detent of the handle engages the appropriate opening in the rear surface of the sear housing and the screw 54 is tightened to lock the housing in position. On subsequent draws of the bow by the user, there is no twist of the bowstring. Of course, if a different user uses the release, he or she can re-adjust the sear housing to eliminate twist based on that produced at full draw by the different user.

In addition, the user can adjust the finger to advance or retard the speed of the release as a matter of personal preference, by loosening the screws 42, moving the finger forwardly or rearwardly about the handle axis, and then tightening the screws.

The indicia on the housing and finger enable the user to quickly and accurately adjust the release to his or her preferred settings.

While the invention has been described as including both adjustable sear housing and an adjustable finger, either feature may be provided independently in an archery release without the other feature.

While the preferred forms and embodiments of the invention have been illustrated and described, it will become apparent to those of ordinary skill in the art that various changes and modifications may be made without deviating from the inventive concepts set forth above.

What is claimed is:

1. An archery release, comprising (a) a handle having a longitudinal axis;

(b) a sear assembly connected with said handle for rotation about an axis normal to said handle axis, said sear assembly including a housing containing a central recess and said handle including a post, said housing recess receiving said post for rotation relative thereto; and (c) a locking mechanism for retaining said sear assembly in a fixed position relative to said handle, whereby twist in a bowstring loop resulting from draw on the bowstring by an archer may be eliminated by adjusting the position of said sear assembly relative to said handle.

2. An archery release as defined in claim 1, wherein said locking mechanism comprises a detent arranged on said handle and a plurality spaced openings arranged within a rear surface of said housing, said detent engaging a selected one of said housing openings when said housing is adjusted to a desired position.

3. An archery release as defined in claim 2, wherein said locking mechanism further comprises a screw which passes through said housing central recess and engages a threaded opening within said handle post.

4. An archery release as defined in claim 1, wherein said sear assembly includes a sear connected with said housing.

5. An archery release as defined in claim 4, wherein said sear assembly includes a sear cage rotatably connected with said housing about an axis parallel to said handle axis.

6. An archery release as defined in claim 5, wherein said sear assembly further includes a hook rotatably connected with said sear cage about an axis parallel to said handle axis, said hook being adapted for engaging the bowstring loop.

7. An archery release as defined in claim 6, wherein said sear contains a lateral groove in an upper surface at one end thereof for engaging said sear cage, said groove cooperating with said sear cage for generating an audible sound when said release is actuated to release said bowstring loop from said hook.

8. An archery release as defined in claim 7, wherein said sear is removably connected with said housing, whereby said sear may be oriented with said one end containing said groove engaging said sear cage when the archer desires for said sear to produce an audible sound when said release is actuated to release said bowstring from said hook or with another end of said sear engaging said sear cage when the archer prefers that no sound be generated when said release is actuated to release said bowstring loop from said hook.

9. An archery release, comprising (a) a handle having a longitudinal axis;

(b) a sear assembly connected with said handle for rotation about an axis normal to said handle axis; and (c) a finger removably connected with said handle and extending radially outwardly therefrom, whereby twist in a bowstring loop resulting from draw on the bowstring by an archer may be eliminated by adjusting the position of said sear assembly relative to said handle.

10. An archery release as defined in claim 9, and further comprising a locking mechanism for retaining said sear assembly in a fixed position relative to said handle.

11. An archery release as defined in claim 10, wherein said sear assembly includes a housing.

12. An archery release as defined in claim 9, wherein said finger is adjustable about said handle axis to increase or decrease the speed of the release.

13. An archery release as defined in claim 12, wherein said handle contains an elongated slot in an outer surface thereof and said finger contains a stem arranged within said slot for adjusting said finger relative to the handle axis.

14. An archery release as defined in claim 13, and further comprising a pinch plate arranged between said finger stem and said handle for fixing said finger in a selected position relative to said handle.

15. An archery release as defined in claim 14, wherein said handle and said pinch plate contain at least one aligned opening, and further comprising a screw for engaging said aligned openings to lock said finger in the selected position.

16. An archery release as defined in claim 15, wherein said finger is contoured to match the fingers of an archer.

17. An archery release, comprising (a) a handle having a longitudinal axis and containing an elongated slot in an outer surface thereof;

(b) a finger extending radially outwardly from said handle and including a stem arranged within said slot for adjusting said finger relative to the handle axis; and (c) a mechanism for connecting said finger with said handle and affording adjustment of said finger about said handle axis.

18. An archery release as defined in claim 17, and further comprising a pinch plate arranged between said finger stem and said handle for fixing said finger in a selected position relative to said handle.

19. An archery release as defined in claim 18, wherein said handle and said pinch plate contain at least one aligned opening, and further comprising a screw for engaging said aligned openings to lock said finger in the selected position.

20. An archery release as defined in claim 19, wherein said finger is contoured to match the fingers of an archer.

* * * * *